US005701550A

United States Patent [19]

Lofftus et al.

[11] Patent Number: 5,701,550

[45] Date of Patent: Dec. 23, 1997

[54] METHOD AND APPARATUS FOR CONTROLLING CHARGE ON TONER IN A TONING STATION

[75] Inventors: Kevin D. Lofftus, Rochester; Thomas K. Hilbert, Spencerport; David A. Roets, Rochester; Jerry E. Livadas, Webster, all of N.Y.

[73] Assignee: Eastman Kodak Company, Rochester, N.Y.

[21] Appl. No.: 620,781

[22] Filed: Mar. 22, 1996

[51] Int. Cl.[6] ..... G03G 15/08

[52] U.S. Cl. ..... 399/44; 399/94; 399/97; 430/122

[58] Field of Search ..... 399/44, 94, 97, 399/236, 253, 267, 276; 430/122, 336

[56] References Cited

U.S. PATENT DOCUMENTS

| | | | |
|---|---|---|---|
| 4,027,621 | 6/1977 | Kane et al. | 399/97 X |
| 4,367,036 | 1/1983 | Sakamaki et al. | 399/96 |
| 4,497,568 | 2/1985 | Komiya et al. | 399/70 |
| 4,546,060 | 10/1985 | Miskinis et al. | 430/108 |
| 4,888,618 | 12/1989 | Ishikawa | 399/39 |
| 4,982,225 | 1/1991 | Sakakibara et al. | 355/30 |
| 5,225,872 | 7/1993 | Fukushima | 399/39 |

FOREIGN PATENT DOCUMENTS

| | | |
|---|---|---|
| 60-159869 | 8/1985 | Japan . |
| 61-223867 | 10/1986 | Japan . |
| 3-132781 | 6/1991 | Japan . |
| 4-29171 | 1/1992 | Japan . |

*Primary Examiner*—Arthur T. Grimley
*Assistant Examiner*—Sophia S. Chen
*Attorney, Agent, or Firm*—Lawrence P. Kessler

[57] ABSTRACT

A substantial change in charge on toner in a development station due to a reduction in relative humidity as the station warms up is compensated for by applying heat from an external source to the station when the station has not been warmed up. For example, when the station is turned off or in a condition of idle. This feature is particularly usable in a station having a rotating magnetic core.

2 Claims, 2 Drawing Sheets

METHOD AND APPARATUS FOR CONTROLLING CHARGE ON TONER IN A TONING STATION

This invention relates to the application of toner to electrostatic images. More specifically, it relates to the control of charge on such toner in a toning station used to develop an electrostatic image.

Electrostatic image forming apparatus use statically charged toner particles to develop electrostatic images on an imaging member. The developed images are then transferred to a receiving sheet. Charged toning particles are applied to the electrostatic image at a toning station. The quality of toner image produced by such apparatus is substantially affected by the charge on the toner.

One class of toning stations controls the charge and presentation to the imaging member of the toner particles through the use of two component developers in which one component is the toner and the other is a particulate carrier, for example, a magnetic carrier. The charge on the toner particles is generated by triboelectrification of rubbing against the carrier particles. Methods for regulation of the toner particle charge include chemical modification of the carrier and toner through chemical treatments, addenda and third components. These modifications provide materials that obtain the proper charge level, maintain a stable charge level over a range of conditions and charge any new toner that enters the station.

Many systems fail to provide a stable charge over the relative humidity range to which such devices are exposed. The result is a wide range of charge levels over which the device must perform adequately. In addition to effects from relative humidity, this range must also take into account effects of developer life, customer job stream, toner concentration control and variability due to toner and developer manufacturing. The upper limit to the charge level at which performance is acceptable may be due to limits of the latent image forming process on the imaging member, to artifacts produced at high toner charge levels during transfer of the toned image to a receiver or to pick up of developer in the image background.

With two component developers, the lower limit to the charge level for acceptable performance is most often defined by contamination of the device by toner dust as a result of low charge toner particles being thrown from the developer. The lower level may also provide unacceptable tone scale when using a gray scale digital process or an optical process.

In two component developers, both charge level and stability can be improved by modifications to both carrier and toner. Combinations of addenda with opposing responses to relative humidity may be used to reduce to eliminate variations in charge due to changes in humidity. However, the results of combined addenda are not entirely predictable and developers with a relatively flat response to humidity are not available for all applications.

U.S. Pat. No. 4,546,060 to Miskinis et al, issued Oct. 8, 1985 describes a two component development system in which high coercivity magnetic carrier is used to present toner to an electrostatic image by very rapid rotation of a cylindrical magnetic core in a magnetic brush applicator. This system is capable of extremely high quality development at high density at very high speed. However, rotation of the core develops heat which gradually increases the temperature of the development station. In conditions of high ambient relative humidity, heat from the station itself reduces the relative humidity in the station as the image forming apparatus warms up from a cold start.

There are other sources of heat in such image forming apparatus, including heat generated by many digital exposure stations, for example, a typical LED printhead.

U.S. Pat. No. 4,888,618 to Ishikawa, issued Dec. 19, 1989 describes an image forming apparatus in which both relative humidity and temperature are sensed. An elaborate algorithm is used to control the various parameters of the machine to adjust the machine for various humidities and temperatures, and their effect on the charge on toner. See also, U.S. Pat. No. 5,225,872, granted to Fukushima Jul. 6, 1993.

U.S. Pat. No. 4,982,225 to Sakakibara et al, granted Jan. 1, 1991 describes an apparatus for forming images on microcapsule paper, which paper is quite sensitive to relative humidity. The machine uses a heater to control the relative humidity to keep it within the process' working range.

U.S. Pat. Nos. 4,367,036 to Sakamaki et al, granted Jan. 4, 1983 and 4,497,568 to Komiya et al, granted Feb. 5, 1985, disclose maintaining the temperature of liquid developer to provide appropriate mobility of the liquid for proper liquid development of an electrostatic image.

SUMMARY OF THE INVENTION

It is an object of the invention to improve the control of charge on toner in a toning station assembly, especially, but not limited to, a toning station having a rotatable magnetic core, rotation of which creates substantial heat.

This and other objects are accomplished by providing a means separate from any rotatable core for heating the supply of developer.

According to a preferred embodiment, the toning station is controlled by a logic and control which includes means for activating the heat applying means during at least a portion of the time that the core is not rotating, for example, when the apparatus is off, idled or at rest.

It is another object of the invention to provide a method of controlling the charge on a toning station in an image forming apparatus, which image forming apparatus generates enough heat in operation that relative humidity in the station gradually decreases as the image forming apparatus is continually operated.

This and other objects are accomplished by applying heat to the station during a time period in which the relative humidity is likely to be high to reduce such relative humidity.

According to a preferred embodiment, either the humidity or the temperature of the toning station is sensed and heat applied in response. Alternatively, conditions of high humidity can be anticipated without benefit of sensing devices and the heat applied during times in which the relative humidity is likely to be high, for example, when the apparatus has not been in operation. This latter approach may appear somewhat less elegant, however, it is considerably less expensive and more robust because it does not rely on sensors.

DETAILED DESCRIPTION OF THE INVENTION

Figure 2:
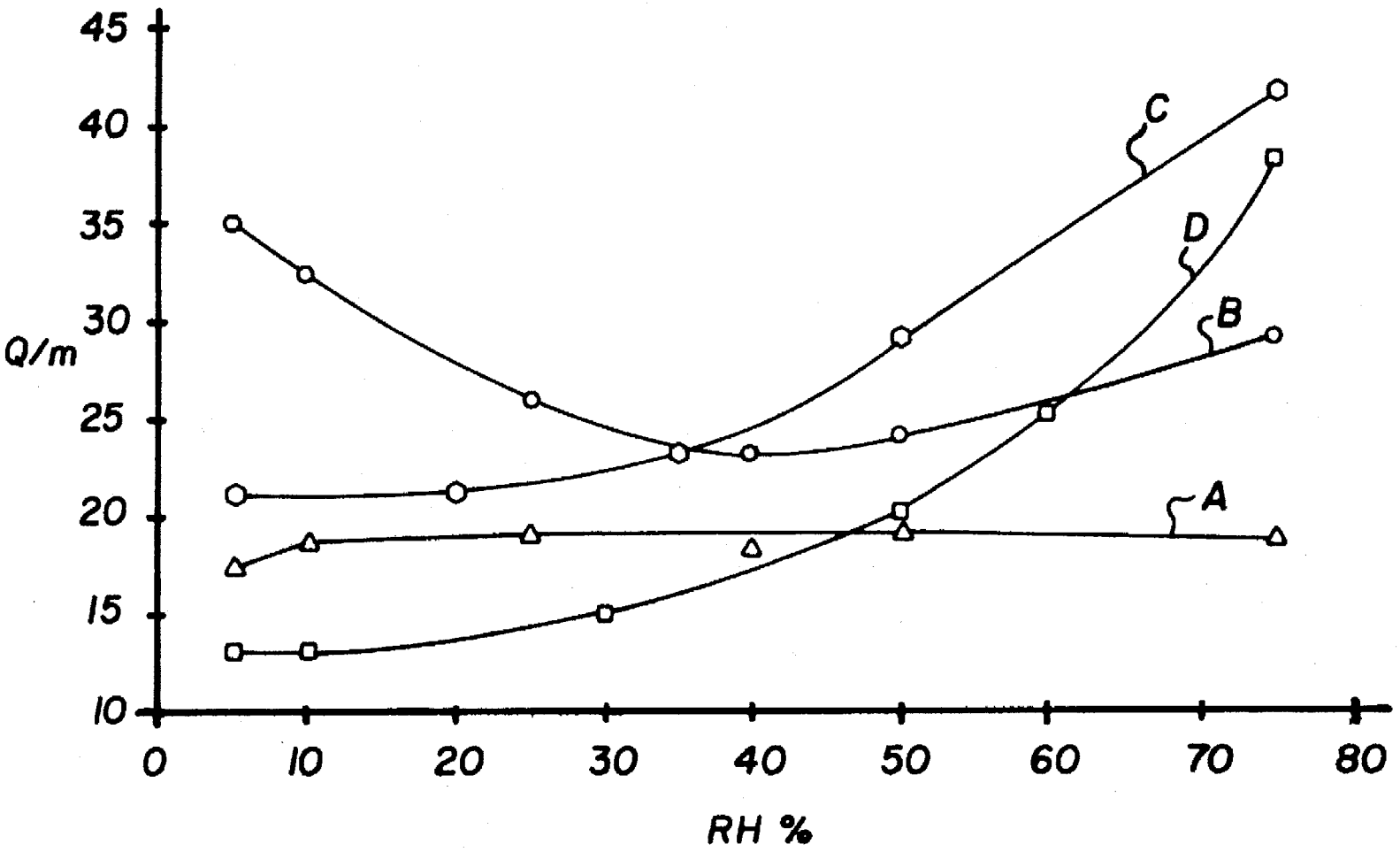
FIG. 2 is a graph providing the charge per unit of mass of toner against relative humidity for four different toner components.

FIG. 2 illustrates a problem posed by various toner components. In FIG. 2 the charge per unit of mass is graphed against the relative humidity for toners with four different toner additives or combinations of additives. Curve A describes a toner having a charge agent which provides a very flat or uniform response to relative humidity. This shape of curve is, of course, highly desirable in a robust system. However, all desirable colors and polarities cannot be obtained with such uniformity of response. Curves B, C and D show the response curves of toners with charge control agents that vary substantially with relative humidity. Curve B shows a combination of agents which provide a toner whose charge decreases with increasing humidity at low humidity and increases with increasing humidity at higher humidities. More typical curves are those shown for addendas C and D which are relatively flat at low relative humidities but become substantially non-linear as the charge increases with higher relative humidities.

The invention can improve the performance of any charge control agent whose response varies over the humidity range the machine is subjected to in a working day. For example, it has particular application to toners having charge control agents which respond like the curves C and D, that is, addenda whose response to humidity changes rapidly as humidity increases from 40% to 70%.

Figure 1:
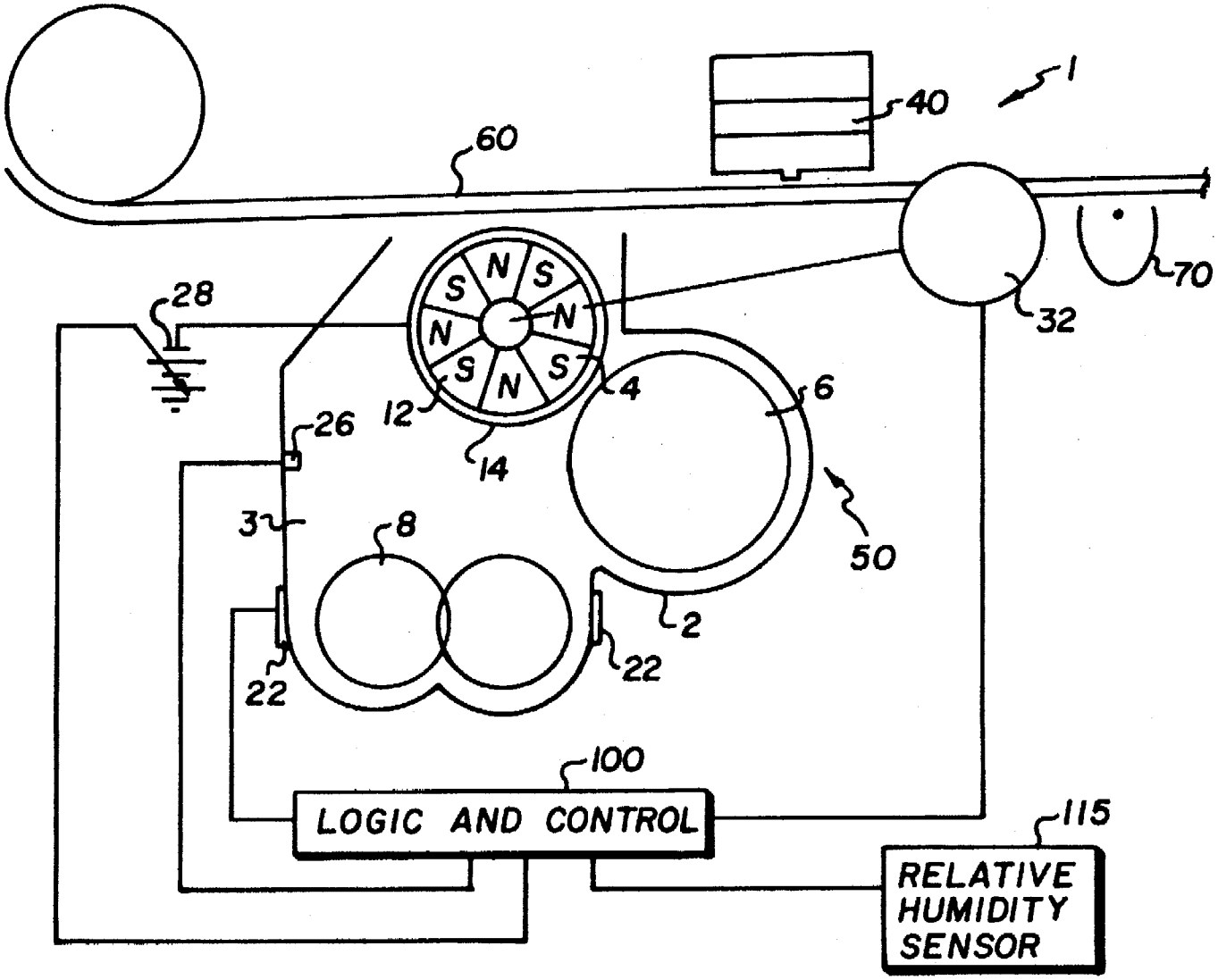
FIG. 1 is a side schematic of a portion of an image forming apparatus.

FIG. 1 shows a portion of an image forming apparatus in which the invention is particularly usable. According to FIG. 1, an image forming apparatus 1 includes an image member 60, for example, a photoconductive web, which is moved continuously through a series of stations to form toner images. Those stations can include a primary charger 70 which applies a uniform charge to the image member 60. An exposure station, for example, an LED printhead 40 imagewise exposes the charged image member 60 to create an electrostatic image. The electrostatic image is then toned by a toning station 50 by the application of finely divided and charged toner particles, all as is well known in the art.

Toning station 50 includes a housing 2 which defines a sump 3 which holds a two component developer, for example, a developer similar to that described in U.S. Pat. No. 4,546,060, referred to above. This developer includes hard magnetic carrier particles. The developer is mixed in the sump by a suitable mixing device, for example, rotating augers 8, and is transported to an applicator 4 by a transport device 6. The applicator 4 moves the toner into contact or close proximity with the electrostatic image in the presence of an electric field provided by a potential source 28 of a direction which urges proper development of the electrostatic image. Applicator 4 includes a shell 14 which may be rotatable and a magnetic core 12 which is rotatable inside the sleeve by a motor 32.

Rapid rotation of core 12 causes the hard magnetic carrier particles to individually flip or form long strands of particles which flip on the surface of the shell 14. This flipping action causes the developer to thoroughly mix, keeping it charged as it develops the electrostatic image. Either or both of the rotating core and shell moves the developer rapidly through a development zone between the applicator and the image member 60.

The core is usually rotated at greater than 500 revolutions per minute, in many devices at greater than 1500 revolutions per minute. This particular approach to magnetic brush development provides extremely high quality images at very high rates of speed. However, it also generates heat from the rapid rotation of the core.

Early apparatus using a rotating core applicator saw a rise in temperature by as much as 30 degrees in the developer sump itself from a cold start to a time several hours into use of the apparatus. In conditions of high relative humidity, this temperature rise is accompanied by a substantial reduction in the relative humidity. If the toner has a response similar to that of component A in FIG. 2, this temperature rise will have little effect on its charge. However, in conditions of high ambient relative humidity, substantial changes in relative humidity will substantially change the charge of developers that respond like components C and D.

According to FIG. 1, a heater 22 is positioned around the sump 3. This heater is used to eliminate humidity conditions in the toning station which are most likely to provide a charge on the toner that is difficult for the apparatus to handle. It reduces the range of relative humidities that the process is exposed to. Preferably, the heater and the magnetic core are controlled together using a logic and control 100 for the image forming apparatus 1. Logic and control 100 is readily programmed to activate heater 22 to apply heat to sump 3 when the temperature in the sump is substantially below that to which the core will raise it.

According to a first embodiment, a temperature sensor 26 senses the temperature of the sump and feeds that information into logic and control 100. Whenever the sump temperature falls below a particular level, heater 22 is activated to bring the temperature up to that level. This is an elegant solution that maintains the temperature at a desired level at all times. However, a less expensive and more robust approach is to predict the temperature of the sump 3 according to the utilization of the station. For example, in its simplest form, when the apparatus is turned off at the end of the day, heater 22 can be turned on and kept on until the apparatus is turned on the following morning. Although this may appear to be an excessive use of energy, in fact, many large printers maintain substantial components overnight to receive data despite a shutdown marking engine. Alternatively, the heater can be set by the logic and control to turn on at 4:30 a.m., anticipating use at, for example, 7:00 a.m., when it can be turned off in response to turning on of the rest of the apparatus.

During the day, typical image forming apparatus of this type is ready to form images in response to proper actuation. Various systems are kept close enough to being warmed up that such a warm-up can take place in an acceptable access time to the operator. Typically, in this idle or rest condition, the core 12 is not rotated and the temperature from some of the other units, for example, printhead 40, is also substantially reduced. According to an alternative embodiment, during these times, logic and control 100 turns heater 22 on in response to a program based on the time since the most recent run and the length of that run. With the beginning of a new run period, the heater 22 is turned off.

Since the elevated temperature of the station typically reduces the relative humidity in the station to a level in which variations are less significant, the heater could be left on at a low level all the time. Thus the heater would contribute to the heat in the system when the core 12 was being rotated but would make sure that the temperature was above a particular level at all times, which level would be chosen according to the curve of a particular toner similar to that shown in FIG. 2. Obviously, the combination of heat from the core and from the heater 22 could not in this instance raise the temperature of the toner above its glass transition temperature.

Since the ultimate variable affecting charge is relative humidity (see FIG. 2), logically it can be sensed directly by a suitable relative humidity sensor 115. Logic and control 100 then turns on heater 22 whenever the relative humidity is above a predetermined amount, say 30%. Similarly, the clock and relative humidity sensor can be combined to turn the heater on at a set time (say, 4:30 a.m.) if the relative humidity is above the predetermined amount (say, 30%). Other such algorithms will appear to those skilled in the art within the spirit and scope of the invention.

The invention has been described in detail with particular reference to a preferred embodiment thereof, but it will be understood that variations and modifications can be effected within the spirit and scope of the invention as described hereinabove and as defined in the appended claims.

We claim:

1. A method of controlling the charge on toner in a toning station in an image forming apparatus including a logic and control receiving input indicative of how long the image forming apparatus has been in an idle condition, which image forming apparatus generates sufficient heat in operation due in part to rotation of a magnetic core in the toning station and the relative humidity in the toning station gradually decreases as the image forming apparatus is continually operated, said method comprising: inputting to the logic and control of the image forming apparatus information indicative that the apparatus is in a run condition when it is forming images, that it is in an idle condition when it is ready to make images but not in fact making images and in an off condition when the image forming apparatus is not ready to make images without a substantial warm-up time, and applying heat to the station during a time period in which the relative humidity is likely to be high to reduce such relative humidity, such heat aplication occurring during both the off condition and at least a portion of the idle condition, and wherein the step of applying heat to the station is responsive to an input that the image forming apparatus has been in an idle condition for a predetermined period of time.

2. A method of controlling the charge on toner in a toning station in an image forming apparatus including a logic and control for receiving input indicative of how long the apparatus has been in an idle condition, which image forming apparatus generates sufficient heat in operation due in part to rotation of a magnetic core in the toning station and the relative humidity in the toning station gradually decreases as the image forming apparatus is continually operated, said method comprising:

inputting to a logic and control of the apparatus information indicative that the apparatus is in a run condition when it is forming images, that it is in an idle condition when it is ready to make images but not in fact making images and in an off condition when the image forming apparatus is not ready to make images without a substantial warm-up time and applying heat to the station during at least a portion of the off condition; and applying heat to the station during a time period in which the relative humidity is likely to be high to reduce such relative humidity, such heat application occurring during both the off condition and at least a portion of the idle condition, and wherein the heat is applied a predetermined time before a time that the image forming apparatus is expected to be switched to a run condition.

* * * * *